US011473771B1

(12) United States Patent
Kavanagh

(10) Patent No.: US 11,473,771 B1
(45) Date of Patent: Oct. 18, 2022

(54) ILLUMINATED WALL COMPOSITION PAN

(71) Applicant: Terry Kavanagh, Hamburg, NY (US)

(72) Inventor: Terry Kavanagh, Hamburg, NY (US)

( * ) Notice: Subject to any disclaimer, the term of this patent is extended or adjusted under 35 U.S.C. 154(b) by 0 days.

(21) Appl. No.: 17/451,421

(22) Filed: Oct. 19, 2021

(51) Int. Cl.
*F21V 33/00* (2006.01)
*E04F 21/06* (2006.01)

(52) U.S. Cl.
CPC ..... *F21V 33/0084* (2013.01); *E04F 21/06* (2013.01)

(58) Field of Classification Search
CPC ..... F21V 33/0084; B25H 3/06; A47G 2023/0658
See application file for complete search history.

(56) References Cited

U.S. PATENT DOCUMENTS 4,782,632 A 11/1988 Matechuk
4,803,604 A * 2/1989 Nichols ..... F21L 2/00 362/800
5,355,289 A * 10/1994 Krenn ..... F21V 33/0036 362/249.14
5,624,029 A 4/1997 Shih
5,779,350 A 7/1998 Chang
5,879,071 A * 3/1999 Sanford, Jr. ..... F21V 33/0028 47/65.5
5,971,101 A 10/1999 Taggart
6,076,937 A * 6/2000 Wood ..... F21S 9/02 362/156
6,616,295 B2 9/2003 Sako et al.
6,662,521 B1 12/2003 Escobedo et al.
6,981,780 B2 1/2006 Einav
7,575,334 B2 8/2009 Becnel
7,914,167 B2 3/2011 Petersen
9,381,639 B2 7/2016 Werner et al.
10,619,362 B2 4/2020 Hyde, III
2002/0131267 A1 9/2002 Van Osenbruggen
2010/0027246 A1 2/2010 Petersen
2012/0285842 A1* 11/2012 Wood ..... E04F 21/02 206/216
2013/0167691 A1 7/2013 Ullrich et al.
2014/0319191 A1* 10/2014 Wood ..... A45F 5/02 224/269
2016/0010849 A1 1/2016 Snellenberger
2017/0066105 A1 3/2017 Grayden

* cited by examiner

*Primary Examiner* — Alexander K Garlen
(74) *Attorney, Agent, or Firm* — Squire Patent Consulting & IP Law LLC; Brendan E. Squire

(57) ABSTRACT

An apparatus and method for illuminating a work area for applying a wall composition. An illuminated wall composition pan provides a lightweight, self-contained carrier for a workspace illumination. The illuminated wall composition pan is configured to retain a protective liner to prevent the pan from becoming soiled by the wall composition. It is also light weight, and a carrier may be provided to assist holding the illuminated wall composition pan. The illuminated wall composition pan includes an elongate tray 18 dimensioned to contain a volume of wall composition and has a length to contain a wall composition applicator tool. The pan has a first end face and a second end face, a front wall, and a back ball. A first plurality of high brightness LED lights are disposed in a spaced apart relation about the first end face and a rechargeable battery carried in the second end face.

8 Claims, 3 Drawing Sheets

ILLUMINATED WALL COMPOSITION PAN

BACKGROUND OF THE INVENTION

The present invention relates to wall composition application, and more particularly to mud pans for containing and dispensing a wall composition, such as drywall muds and plasters.

When applying wall compositions to finish a wall surface, it is important that the composition be applied with to a smooth, level finish to avoid imperfections in the wall surface. This is equally important for drywall muds typically utilized to join seams between drywall panels and plasters applied as a wall surface.

During renovations, and particularly during new construction, the worksite may not have utilities connected, or if connected, the work area may not have all the lighting fixtures installed so that the work area is poorly illuminated. The low or no illumination conditions can make it difficult for the worker applying the drywall composition to determine if the surface is smooth and level.

Due to the dense materials and high liquid content, wall compositions can be heavy for the worker to carry, particularly when working at higher elevations of the wall. It is therefore important that the pan carrying the wall composition be lightweight. Likewise, because the wall composition materials are prone to splatter, it is also desirable that the pan be protected from becoming dirty and are readily cleaned up if they do become soiled with wall composition.

As can be seen, there is a need for an illumination tool for wall composition application that is light weight and readily cleaned.

SUMMARY OF THE INVENTION

In one aspect of the present invention, an illuminated wall composition pan is disclosed. The illuminated wall composition pan includes an elongate tray having a first end face, a second end face, a front wall, and a back wall. The elongate tray is dimensioned to contain a volume of a wall composition. A first plurality of high brightness LED lights are disposed in a spaced apart relation about the first end face. A rechargeable battery carried in the second end face.

In some embodiments, a conductor is carried in one of the front wall and the back wall, the conductor interconnecting the rechargeable battery and the first plurality of high brightness LED lights.

In some embodiments, a second plurality of high brightness LED lights disposed spaced apart about the front wall along a length of the elongate tray.

In some embodiments, a charging port defined in the second end face configured for coupling with a power source to recharge the rechargeable battery.

In some embodiments, the front wall and the back wall are continuous with the first end face, the second end face, and a bottom.

In some other embodiments, the front wall and the back wall comprise a spar interconnecting the first end face with the second end face.

In some embodiments, a removeable liner is adapted to be received within the elongate tray.

In a preferred embodiment, the first plurality of high brightness LED lights have a color of between about 3000K-to approximately 4100K. The second plurality of high brightness LED lights, when provided, have a color of between about 3000K-to approximately 4100K.

In some embodiments, the rechargeable battery is encased in a waterproof thermoplastic.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an apparatus and method for illuminating a work area for applying a wall composition. An illuminated wall composition pan according to aspects of the present invention provides a lightweight, self-contained carrier for a workspace illumination. The illuminated wall composition pan is configured to retain a protective liner to prevent the pan from becoming soiled by the wall composition. The illuminated wall composition pan is also light weight, and a carrier may be provided to assist holding the illuminated wall composition pan.

Figure 1:
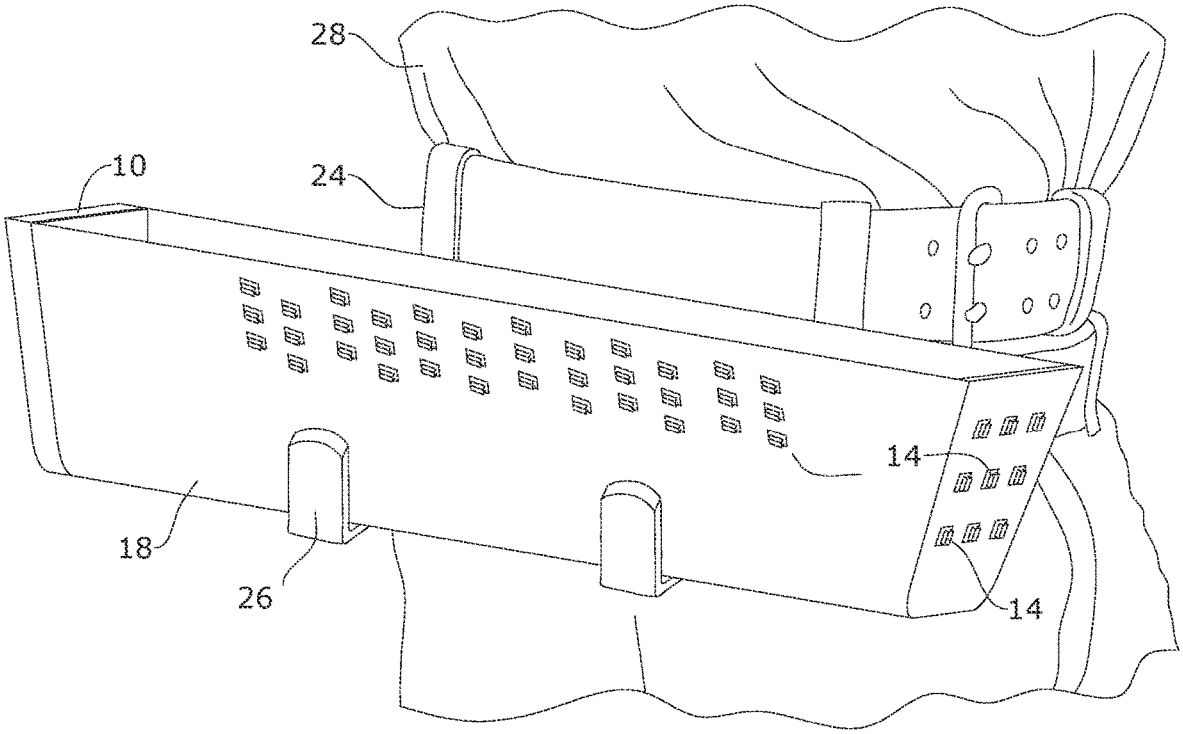
FIG. 1 is a perspective view of the illuminated wall composition pan, shown in use.
Figure 2:
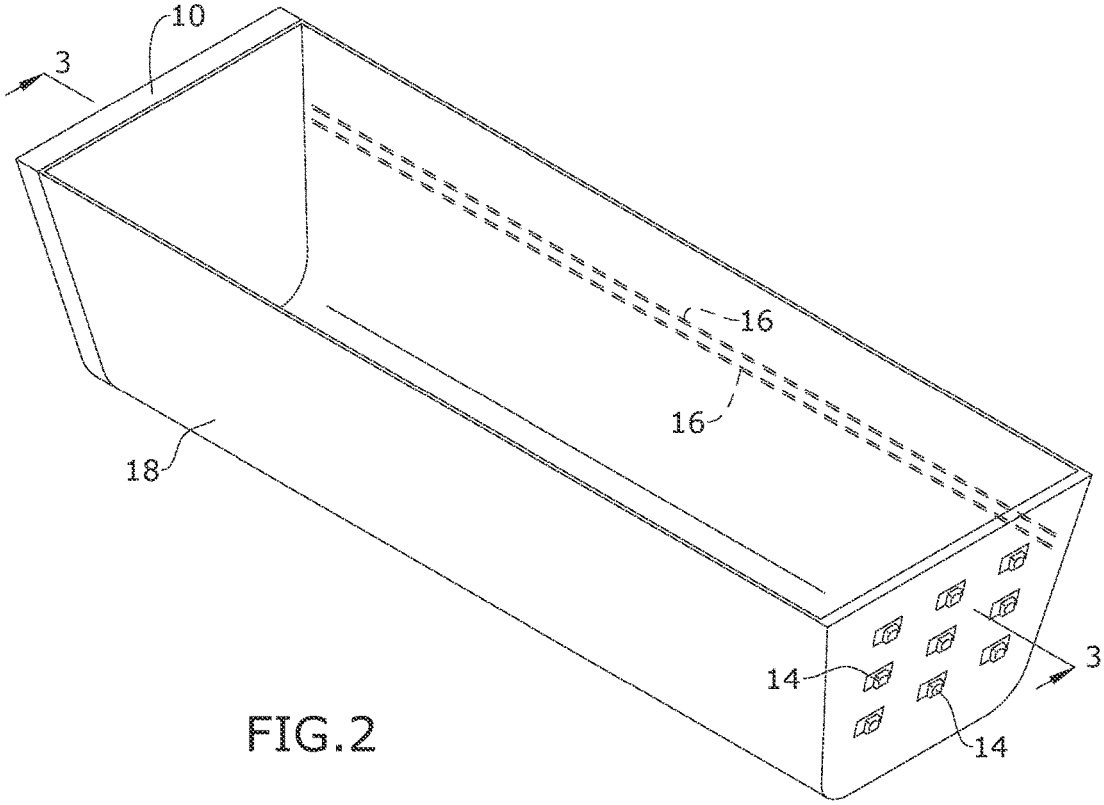
FIG. 2 is a perspective view of the illuminated wall composition pan.
Figure 3:
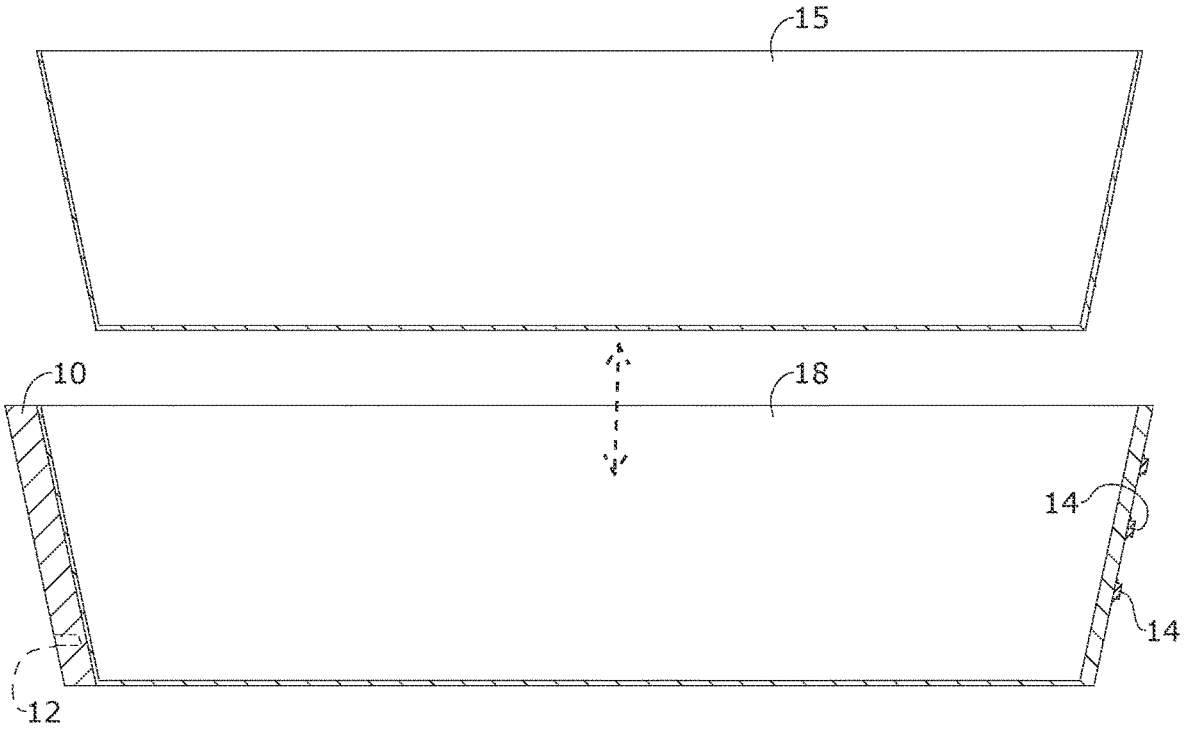
FIG. 3 is a section view taken along 3-3 in FIG. 2.
Figure 4:
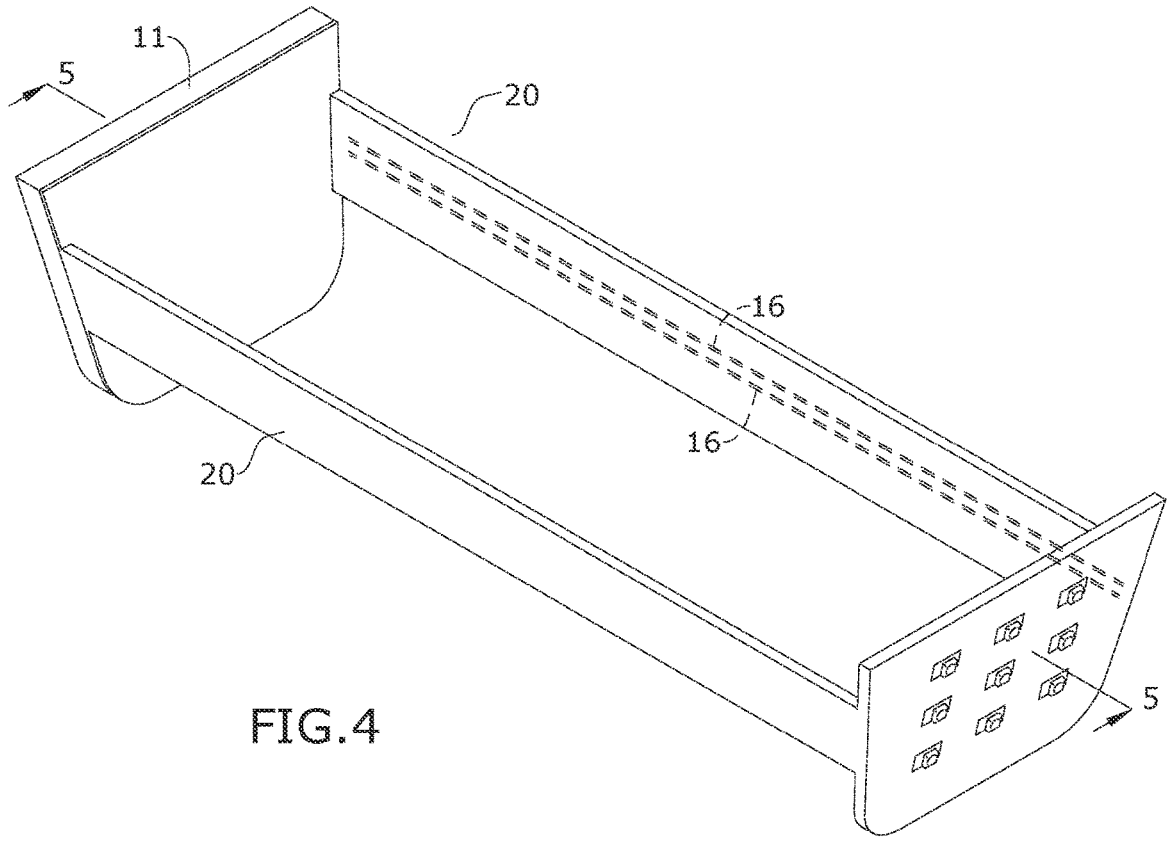
FIG. 4 is an alternate embodiment of the illuminated wall composition pan.
Figure 5:
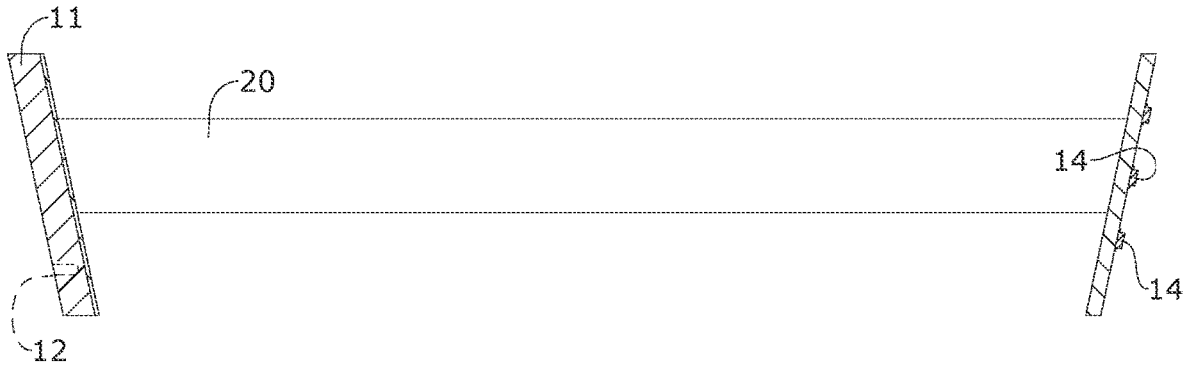
FIG. 5 is a section view taken along 5-5 in FIG. 4.

As seen in reference to the drawings of FIGS. 1-5, non-limiting embodiments of an illuminated wall composition pan are shown. The illuminated wall composition pan includes an elongate tray 18 dimensioned to contain a volume of wall composition and has a length to contain a wall composition applicator tool, typically on the order of about 6" to 14". The illuminated wall composition pan will have a width of about 4" to 5" to receive the wall composition corner applicator tool.

At least a first end of the illuminated wall composition pan has a plurality of high brightness LED lights 14 disposed in a spaced apart relation about the first face, The plurality of high brightness LED lights 14 may also be disposed in a spaced apart relation about a front wall, wall facing, face along a length of the elongate tray 18. For optimum performance in illuminating irregularities in the wall composition applied to the wall, the plurality of high brightness LED lights 14 will preferably have an illumination of between about 500 to 1500 lumens. In some embodiments, a switch allows for an inspection selection where the plurality of high brightness LED lights 14 illuminate at about 500 lumens for inspection purposes to detect irregularities in the wall surface and a work light selection where the high brightness LED lights 14 illuminate at about 1500 lumens to provide a work light for applying the wall composition to the wall. More preferably, the plurality of high brightness LED lights 14 are selected to have a bright white color (approximately 3000K-to approximately 4100K) for detecting surface irregularities.

A rechargeable battery 10 is carried in a second end of the illuminated wall composition pan. The rechargeable battery 10 is encased in a suitable waterproof barrier, such as a thermoplastic material. Conductors 16 are carried in one of the front walls between and the back wall to interconnect the battery 10 and the plurality of high brightness LED lights 14. A charge port 12, such as a USB or other suitable connector is provided to recharge In another non-limiting embodiment, the elongate tray 18 is also defined by a first and a second end wall. A plurality of high brightness LED lights 14 are carried in a spaced apart relation on the first end wall. A rechargeable battery 11 is carried within the second end wall of the elongate tray 18. In this embodiment, a front spar 20 and a back spar 22 are formed as strips interconnecting the first end wall and the second end wall. The conductors 16 are carried within one of the front spar 20 and the back spar 22 to interconnect the battery 11 and the plurality of high brightness LEDs 14. Each of the elongate tray 18, the front spar 20 and the back spar 22 are formed of a light weight material, such as an aluminum or thermoplastic material. A switch (not shown) is operable to selectively illuminate each of the plurality of high brightness LEDs 14.

A liner 15 is received within the illuminated wall composition pan to prevent the accumulation of wall composition on the pan during use. The liner 15 may be formed of a rigid or a semi-rigid plastic material and is removable from the pan for easy clean up after completion of a project.

The illuminated wall composition pan may be suspended from the waist of a user 28 via suspension hook. The suspension hook includes a beltloop 24 received on a belt of the user 28, and a hook 26 that is disposed at a bottom end of the beltloop 24. The hook 26 is dimensioned to span the elongate tray 18 between the front wall and the back wall and retains the illuminated wall composition pan in an upright, hands-free orientation. When combined with the plurality of high brightness LED lights 14, the illuminated wall composition pan allows the user 28 to utilize both hands to apply the wall composition, inspect the surface for irregularities, and smooth the wall composition with a wall composition applicator tool.

It should be understood, of course, that the foregoing relates to exemplary embodiments of the invention and that modifications may be made without departing from the spirit and scope of the invention as set forth in the following claims.

I claim:

1. An illuminated wall composition pan, comprising:

an elongate tray having a first end face and a second end face, a front wall and a back wall, the elongate tray dimensioned to contain a volume of a wall composition;

a first plurality of high brightness LED lights disposed in a spaced apart relation about the first end face, a second plurality of high brightness LED lights disposed spaced apart about the front wall along a length of the elongate tray, a rechargeable battery carried in the second end face, and a conductor carried in one of the front wall and the back wall, the conductor interconnecting the rechargeable battery and the first plurality of high brightness LED lights.

2. The illuminated wall composition pan of claim 1, further comprising:

a charging port defined in the second end face configured for coupling with a power source to recharge the rechargeable battery.

3. The illuminated wall composition pan of claim 1, wherein the front wall and the back wall are continuous with the first end face, the second end face, and a bottom.

4. The illuminated wall composition pan of claim 1, wherein the front wall and the back wall comprise a spar interconnecting the first end face with the second end face.

5. The illuminated wall composition pan of claim 4, further comprising:

a removeable liner adapted to be received within the elongate tray.

6. The illuminated wall composition pan of claim 5, wherein the first plurality of high brightness LED lights have a color of between about 3000K-to approximately 4100K.

7. The illuminated wall composition pan of claim 1, wherein the second plurality of high brightness LED lights have a color of between about 3000K-to approximately 4100K.

8. The illuminated wall composition pan of claim 1, wherein the rechargeable battery is encased in a waterproof thermoplastic.

* * * * *